US007225930B2

(12) United States Patent
Ford et al.

(10) Patent No.: US 7,225,930 B2
(45) Date of Patent: Jun. 5, 2007

(54) COMBINATION SHIPPING CARTON AND TWIN DISPENSER BOXES

(75) Inventors: Colin Ford, Woodstock, GA (US); Raymond Spivey, Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 45 days.

(21) Appl. No.: 10/701,882

(22) Filed: Nov. 5, 2003

(65) Prior Publication Data

US 2005/0092649 A1 May 5, 2005

(51) Int. Cl.
*B65D 1/22* (2006.01)

(52) U.S. Cl. ..... 206/746; 229/120.09

(58) Field of Classification Search ..... 206/746, 206/747, 749, 750, 774, 736; 229/208, 238, 229/240, 242, 120.09, 120.12
See application file for complete search history.

(56) References Cited

U.S. PATENT DOCUMENTS

| | | | | |
|---|---|---|---|---|
| 1,656,919 | A | 1/1928 | Marsh | |
| 1,901,483 | A | 3/1933 | Ware, Jr. | |
| 1,925,102 | A | 9/1933 | Levkoff | |
| 2,027,079 | A | 1/1936 | Weiss | |
| 2,141,743 | A | 12/1938 | Ethridge | |
| 2,145,430 | A | 1/1939 | New | |
| 2,152,079 | A * | 3/1939 | Mott | 206/746 |
| 3,002,613 | A * | 10/1961 | Merkel et al. | 206/193 |
| 3,276,665 | A | 10/1966 | Rasmussen | |
| 3,280,968 | A | 10/1966 | Craine | |
| 3,653,495 | A * | 4/1972 | Gray | 206/746 |
| 3,759,378 | A | 9/1973 | Werth | |
| 3,786,914 | A | 1/1974 | Beutler | |
| 3,884,348 | A | 5/1975 | Ross | |
| 4,008,849 | A | 2/1977 | Baber | |
| 4,113,100 | A | 9/1978 | Soja et al. | |
| 4,558,785 | A | 12/1985 | Gordon | |
| 4,742,917 | A | 5/1988 | Bornwasser | |
| 4,773,541 | A | 9/1988 | Riddell | |

(Continued)

FOREIGN PATENT DOCUMENTS

| | | |
|---|---|---|
| DE | 2 320 190 | 11/1973 |

(Continued)

*Primary Examiner*—Shian T. Luong
(74) *Attorney, Agent, or Firm*—Womble Carlyle Sandridge & Rice, PLLC

(57) ABSTRACT

A combination shipping and dispensing carton for carrying pouches which can be converted into side-by-side dispensers for dispensing pouches in their upright position on the shelves of stores. The carton has a bottom panel, top panel and adjoining side panels and flaps for closing the ends of the carton. The carton has a pair of tear lines extending through one side panel and a fold line extending in the other side panel which are interconnected so that when the tear lines are torn the carton can be formed into side-by-side dispensers by folding the fold line. This shipping carton carries the pouches in two rows with the tops of the pouches in each row meeting near the center of the carton and overlapping so that the length of the carton is less than two times the length of a pouch.

The length of the carton can be from approximately the length of a pouch to one and half times the length of a pouch, depending upon the configuration of the pouches and how full they are filled.

28 Claims, 6 Drawing Sheets

U.S. PATENT DOCUMENTS

| | | | | |
|---|---|---|---|---|
| 4,815,609 | A | 3/1989 | Kiedaisch | |
| 4,886,160 | A | 12/1989 | Kligerman | |
| 5,181,650 | A | 1/1993 | Hollander et al. | |
| 5,699,957 | A | 12/1997 | Blin et al. | |
| 5,842,576 | A | 12/1998 | Snow | |
| 5,857,570 | A * | 1/1999 | Brown | 206/427 |
| 5,881,884 | A | 3/1999 | Podosek | |
| 5,921,398 | A * | 7/1999 | Carroll | 206/736 |
| 5,927,498 | A * | 7/1999 | Saam | 206/499 |
| 5,979,749 | A | 11/1999 | Bozich | |
| 6,129,211 | A | 10/2000 | Prakken et al. | |
| 6,135,289 | A | 10/2000 | Miller | |
| 6,419,152 | B1 | 7/2002 | Tokarski | |
| 6,435,351 | B1 | 8/2002 | Gibb | |
| 6,478,159 | B1 | 11/2002 | Taylor et al. | |
| 6,510,982 | B2 | 1/2003 | White | |
| 6,523,692 | B2 * | 2/2003 | Gregory | 206/746 |
| 2002/0043554 | A1 | 4/2002 | White | |
| 2002/0170845 | A1 | 11/2002 | Oliff | |

FOREIGN PATENT DOCUMENTS

| | | |
|---|---|---|
| EP | 0 704 386 A1 | 4/1996 |
| FR | 1.379.931 | 11/1964 |
| GB | 1 218 016 | 1/1971 |
| WO | WO 99/31593 | 7/1998 |
| WO | WO 03/082686 A1 | 10/2003 |
| WO | WO 2004/063031 A1 | 7/2004 |

* cited by examiner

COMBINATION SHIPPING CARTON AND TWIN DISPENSER BOXES

BACKGROUND OF THE INVENTION

1. Field of the Invention

The present invention relates generally to a combination shipping carton for shipping pouches which can be easily converted into twin boxes for dispensing and displaying the pouches to the consumer. This invention has a unique feature in a combination of a fold line in one side panel and of tear lines in the carton for converting the shipping carton into twin boxes for dispensing and displaying the pouches.

2. Background

Many food products, such as drinks, small pieces of candy, snack mixes of small pieces of food (e.g. trail mix), and the like are packaged and sold to the consumer in pouches made of a composite material. These pouches tend to be small in size (e.g. 200 milliliters or 100 grams). These pouches are presently shipped to the store in a shipping container and these are removed and placed on the shelf individually in groups or displayed in the shipping container.

Neither of these options for displaying and dispensing these pouches to the consumer is very satisfactory.

SUMMARY OF THE INVENTION

This invention relates to twin boxes for dispensing and displaying pouches containing food products on shelves for sale to consumers. These twin dispenser boxes are converted from a shipping carton for shipping the pouches to the store. The shipping carton has a bottom panel, top panel and foldably attached adjoining side panels and flaps for closing the ends of the carton. The pouches are put into the carton when it has been formed basically into a tray with a lid and the lid closed and sealed. When the shipping carton arrives at the store, it can be converted into side-by-side dispensers for dispensing and displaying the pouches to the consumer. This conversion can be made because the shipping carton has a pair of tear lines that extend through a side panel with a fold line in the other side panel and an interconnection between the tear lines and the fold line for converting the carton into side-by-side dispensers.

In one embodiment the tear lines are parallel to each other and produce side-by-side dispensers with front walls designed to be placed near the front edge of the shelf, with the height of the front wall being high enough from the bottom of the dispenser to securely hold the pouches. In another embodiment, the pair of tear lines in the side panel diverge away from each other from the top panel to the bottom panel and enter the bottom panel and are substantially parallel to each other through most of the bottom panel so that front wall of each side-by-side dispenser is low enough to the bottom of the dispenser to display more of the advertising and information on the front of the pouch to the consumer.

While these dispensers are designed to be displayed side-by-side and are attached to each other by a single fold line in a side panel of the shipping carton, the fold line can be interspersed with cuts so the dispensers may be separated from each other and displayed separately.

In respect to both of these embodiments, the shipping carton is designed so that it can be packed tightly with pouches to save material used in constructing the carton and to produce a tightly packed shipping carton which helps prevent damage to the pouches. Many of these pouches are constructed so that the tops of the pouches are not as full of product as the bottom of the pouch. Consequently, the pouches in both of these embodiments are packed in an interleaving fashion so that the tops of pouches in opposite rows meet at the center of the carton and overlap each other. In other words, the bottoms of some of the pouches are adjacent to one end of the carton while the bottoms of other pouches are adjacent the other end of the carton. Two rows of pouches are packed in these shipping cartons. Because of this overlapping, the length of the carton is less than two times the length of a pouch, the extent to which the length of the carton can be less than two times the length of pouch depends upon how full the pouches are filled near their tops and how the pouches are constructed. From one quarter to one half of the length of a pouch may overlap with the corresponding length of an adjoining pouch, at the top of the pouches, so the length of the shipping carton may be from approximately the length of one pouch to one and half times the length of a pouch.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

DETAILED DESCRIPTION OF THE PREFERRED EMBODIMENTS

Figure 1:
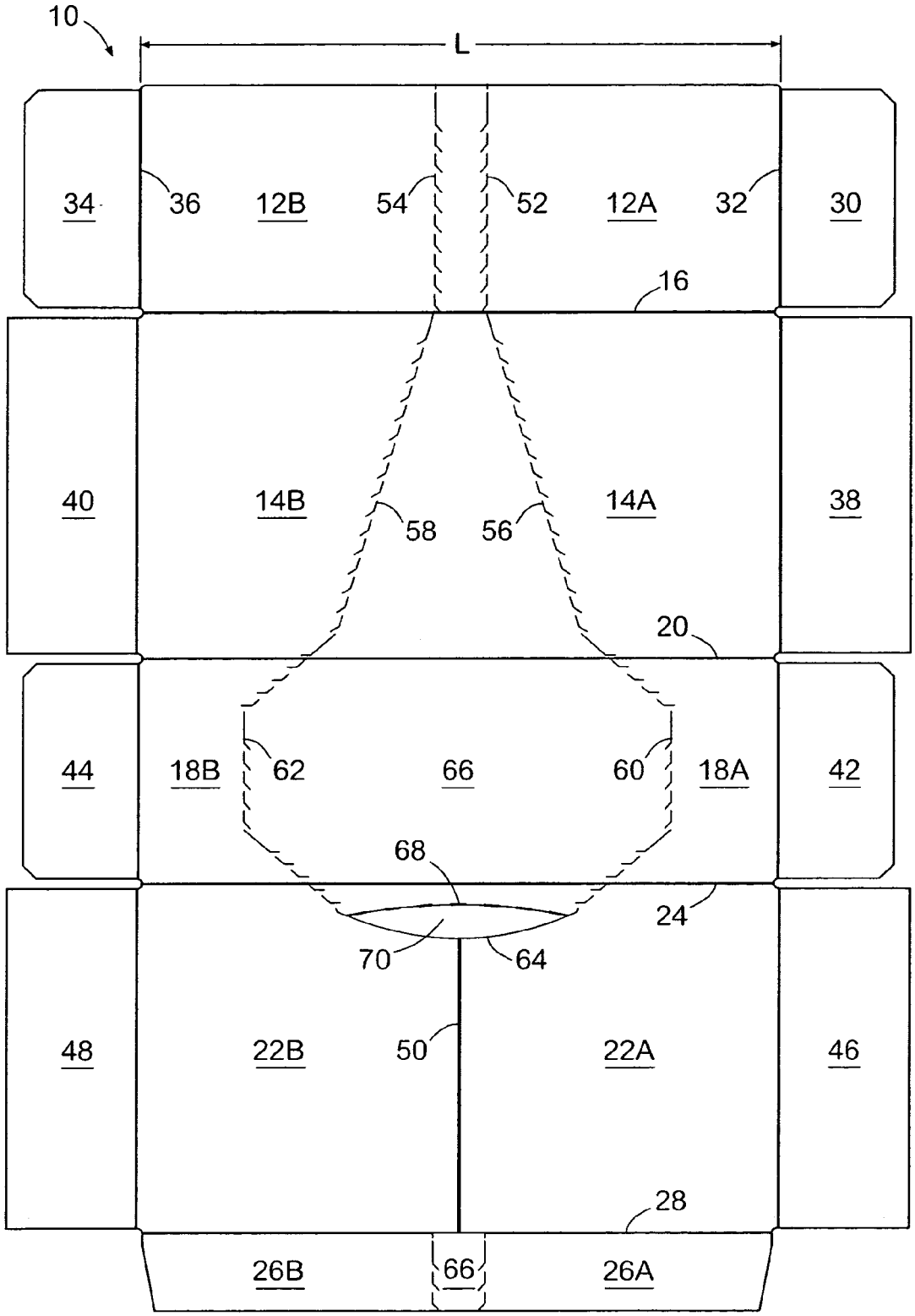
FIG. 1 is plan view of the blank of one embodiment of this invention from which a combination shipping carton and twin shelf dispensers for pouches is formed.

The present invention is intended primarily for use with pouches of the types used to contain drinks, bits of candy, other bits of food, such as a trail mix, and the like. The blank for the carton can be formed from various substrates, such as paperboard, corrugated board, z-flute and the like.

The blank 10 for this embodiment of the invention has a top flap 12A & 12B which is attached to side panel 14A & 14B by fold line 16, which in turn is attached to bottom panel 18A & 18B by fold line 20. Bottom panel 18A & 18B is attached to side panel 22A & 22B by fold line 24, and in turn attached to top flap 26A & 26B by fold line 28.

The ends of the carton are closed by providing top end flap 30 which is attached to top flap 12A by fold line 32 and top end flap 34 which is attached to top flap 12B by fold line 36. Side end flap 38 is attached to side panel 14A by fold line 32 and side end flap 40 is attached to side panel 14B by fold line 36. Bottom end flap 42 is attached to bottom panel 18A by fold line 32 and bottom end flap 44 is attached to bottom panel 18B by fold line 36. Side end flap 46 is attached to side panel 22A by fold line 32 and side end flap 48 is attached to side panel 22B by fold line 36.

It will be understood by those skilled in the art that the carton of the present invention is generally symmetrical about a horizontal line of bisection, as viewed when FIG. 1 is rotated lengthwise. This symmetry aids in the efficient production of the present carton.

Figure 2:
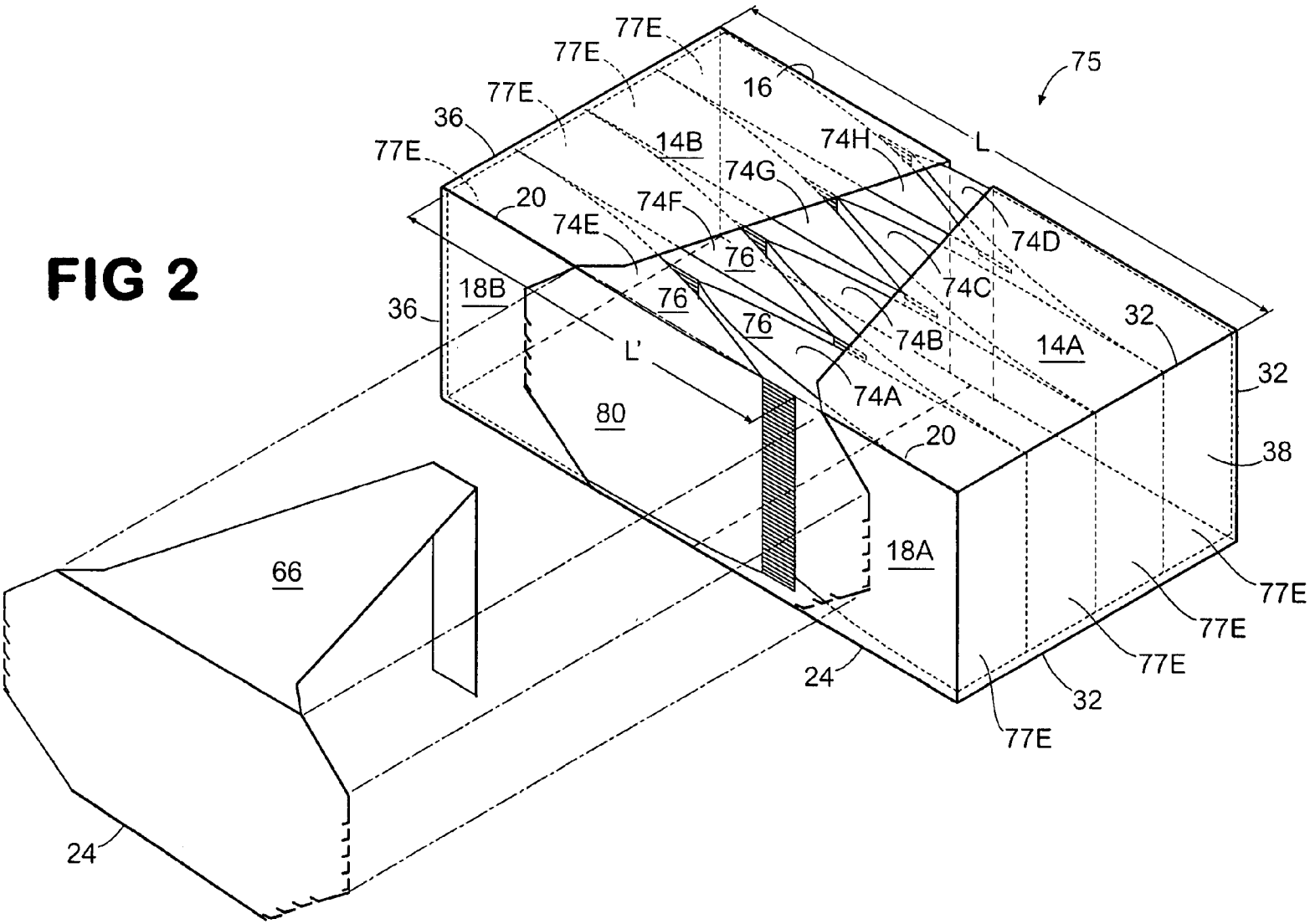
FIG. 2 is a perspective view of the shipping carton of this invention made from the blank of FIG. 1 from which the opening flap has been removed for conversion of the shipping carton into twin shelf dispensers for displaying and dispensing pouches.

The shipping carton of this invention is formed by folding fold lines 16 and 20 of the blank as illustrated in FIG. 1 and folding top end flap 30, side end flap 38, and bottom end flap 42 which are glued together. At the same time top end flap 34, side end flap 40, and bottom end flap 44 are folded inwardly and glued together to form the shipping carton 75 (as shown in FIG. 2). Preferably side end flaps 38 and 40 are glued in the overlapping position over top end flap 30 and bottom end flap 42 and top end flap 34 and bottom end flap 44 respectively. Pouches 74A-H containing food products are loaded into the shipping carton 75 with one of their sides (preferably the front side 80) facing the bottom panel 18A & 18b while the shipping container 75 is resting on side panel 14A & 14B. The carton is closed by folding side panel 22A & 22B along fold line 24 and folding top flap 26A & 26B along fold line 28, and gluing it to top flap 12A & 12B. Side end flaps 46 and 48 are folded along fold lines 32 and 36 respectively and glued to side end flaps 38 and 40 respectively. It should be realized that the shipping carton 75 can be loaded while resting on side panel 22A & 22B as shown in FIG. 2.

It will be noticed that the pouches 74A-D are loaded so that their tops 76 meet the tops of pouches 74E-H at the center of the shipping carton 75 and overlap each other. This can be done because the tops 76 of the pouches are typically not as full of products as the rest of the pouch and there is a shorter distance from the front side 80 to the back side (not shown) of each pouch 74A-H at the top 76 than at the bottom end 77E. This overlapping of the tops 76 of the pouches 74A-H permits the length L between fold line 32 and 36 to be much less than double the length L' of a pouch 74A-H. Because from one fourth to one half of the top end of the pouch may overlap with the corresponding distance of an adjoining pouch, the length L of a carton may be from approximately the length L' of a pouch to one and half times the length L' of a pouch. This results in considerable savings in shipping costs, as less material is required to construct the shipping carton 75. This interleaving of the tops 76 of the pouches 74A-H also results in a shipping carton 75 that is more tightly packed which reduces the likelihood of damage to the pouches 74A-H through the carton 75 during shipment.

It will be noticed from FIG. 1 that the blank 10 is provided with a twin box fold line 50 separating side panel 22A & 22B which extends from fold line 28 to a position close to fold line 24 or all the way to fold line 24. Parallel tear lines 52 and 54 are provided between top flap 12A & 12B. These tear lines 52 and 54 extend into side panel 14A & 14B as tear lines 56 and 58 which diverge from each which may commence at fold line 16 and extend to fold line 20. These tear lines 56 and 58 extend into bottom panel 18A & 18B and are parallel throughout most of their length between fold lines 20 and 24 to each other and to fold line 32 and 36. These tear lines 60 and 62 extend into side panel 22A & 22B and meet each other at the end twin box fold line 50. These tear lines 60 and 62 can meet at fold line 24 or in bottom panel 18A & 18B near fold line 24. A fold line 68 may be provided for establishing a starting flap 70 for opening flap 66 to ease grabbing the starting flap 70. Tear line 60 and 62 may be converted into a cut line 64 to facilitate opening the opening flap 66.

The shipping carton 75 may be opened by grabbing starting flap 70 and tearing opening flap 66 along tear lines 60, 62, 56, 58, 52 and 54 all the way to fold line 28 where the opening flap 66 meets the twin box fold line 50. This opening flap 66 may be removed from the shipping carton 75 as illustrated in FIG. 2.

Figure 3:
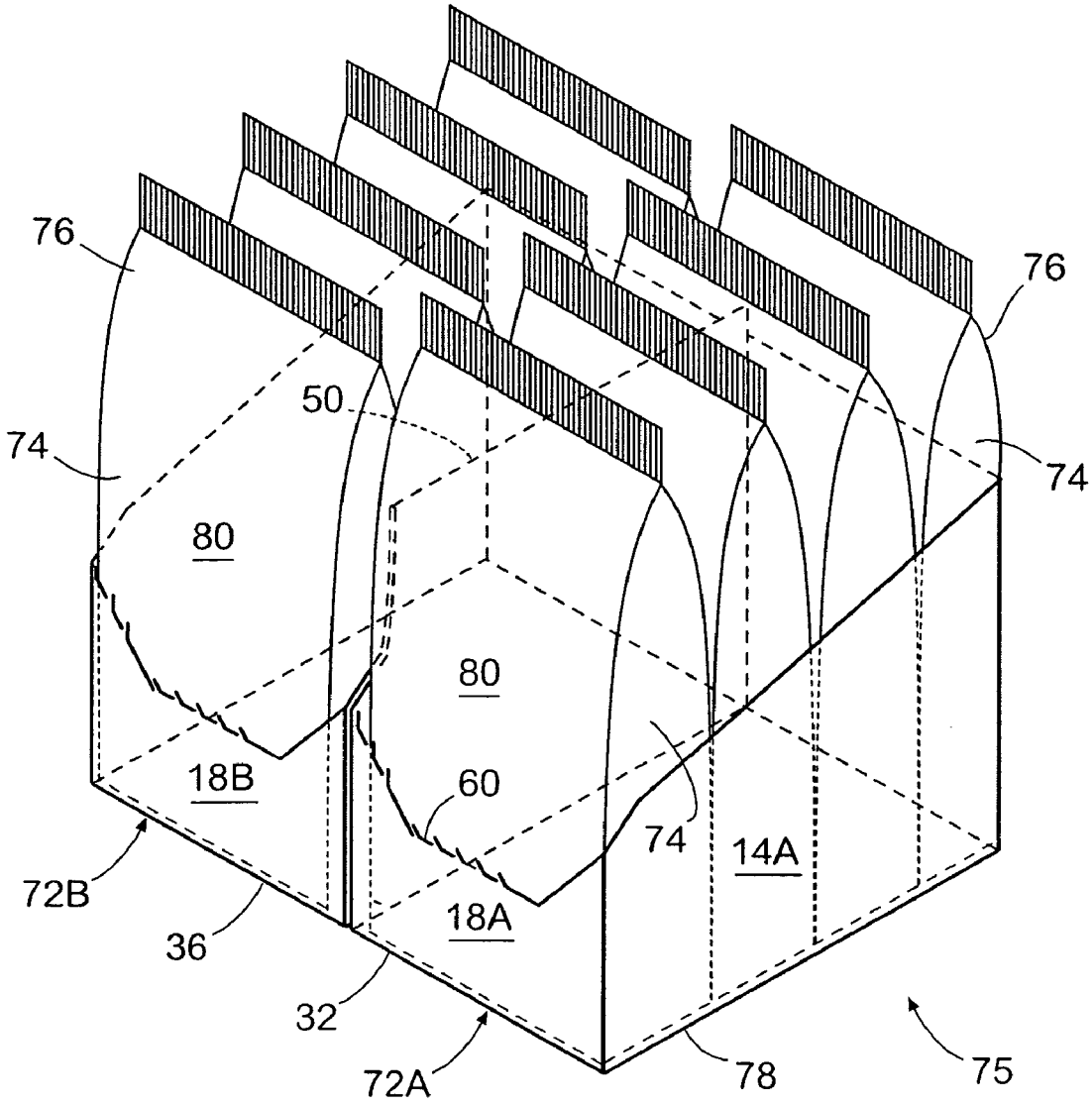
FIG. 3 is a perspective view of the shipping carton of FIG. 2 which has been folded into twin shelf dispensers for displaying and dispensing pouches which are shown in the dispensers.

The shipping carton 75 can then be folded along twin box fold lines 50 to be formed into twin shelf dispensers 72A & 72B as illustrated in FIG. 3 in which the pouches 74 are displayed in their upright position with the top 76 of each pouch 74 located in the proper position for display purposes and dispensing. The bottom 78 of shelf dispenser 72A is formed by top end flap 30, side end flap 38, bottom end flap 42 and side end flap 46. The bottom (not shown) of shelf dispenser 72B is formed from the corresponding end flaps of the blank 10.

It will be noticed that since tear line 60 is located close to fold line 32 most of the front side 80 of the pouch 74 is displayed for advertising and identification purposes. This also facilitates easy removal of the pouch 74 by the consumer. These shelf dispensers 72A & 72B are designed to be displayed side-by-side on the shelf of the store for easy access by a consumer. Shelf dispensers 72A & 72B can be separated from each other by cutting twin box fold line 50 which is the only place of attachment of shelf dispenser 72A to shelf dispenser 72B. Twin box fold line 50 can be constructed as a tear line for easy separation of the shelf dispensers 72A & 72B.

Figure 4:
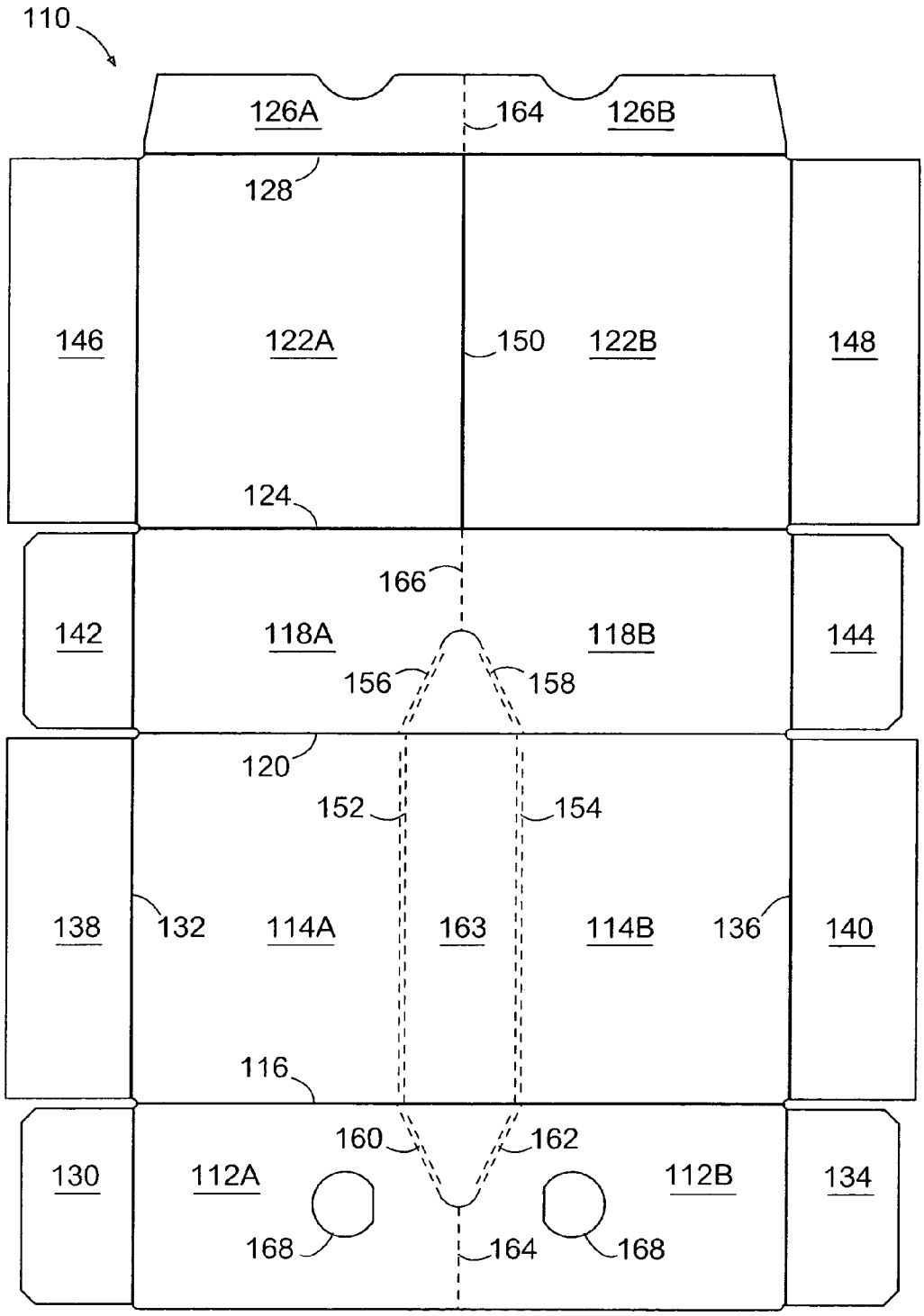
FIG. 4 is a plan view of a blank of another embodiment of this invention from which a combination shipping carton and twin shelf dispensers for pouches can be formed.

The blank for another embodiment of this invention is illustrated in FIG. 4. The blank 110 for this embodiment of the invention has a top flap 112A & 112B which is attached to side panel 114A & 114B by fold line 116, which in turn is attached to bottom panel 118A & 118B by fold line 120. Bottom panel 118A & 118B is attached to side panel 122A & 122B by fold line 124 and in turn attached to top flap 126A & 126B by fold line 128.

The ends of the carton are closed by providing top end flap 130 which is attached to top flap 112A by fold line 132 and top end flap 134 which is attached to top flap 112B by fold line 136. Side end flap 138 is attached to side panel 114A by fold line 132 and side end flap 140 is attached to side panel 114B by fold line 136. Bottom end flap 142 is attached to bottom panel 118A by fold line 132 and bottom end flap 144 is attached to bottom panel 118B by fold line 136. Side end flap 146 is attached to side panel 122A by fold line 132 and side end flap 148 is attached to side panel 122B by fold line 136.

Figure 5:
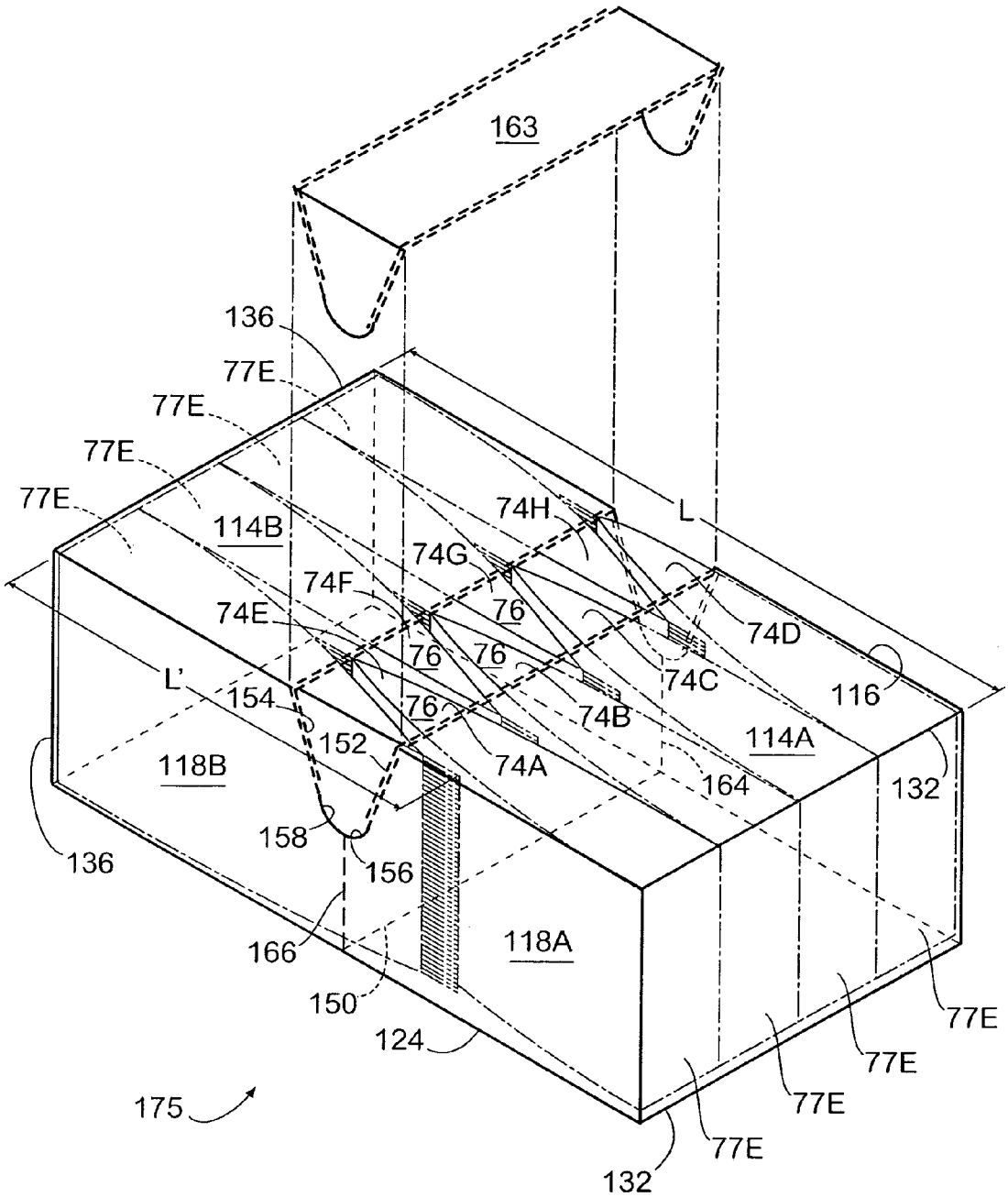
FIG. 5 is a perspective view of a combination shipping carton and twin shelf dispensers formed from the blank of FIG. 4 from which the opening flap has been removed for conversion of the shipping carton into twin shelf dispensers for displaying and dispensing pouches.

The shipping carton of this invention is formed by folding fold lines 116 and 120 of the blank as illustrated in FIG. 4 and folding top end flap 130, side end flap 138 and side end flap 142 which are glued together. At the same time top end flap 134, side end flap 140 and bottom end flap 144 are folded inwardly and glued together to form the shipping carton. Preferably side end flaps 138 and 140 are glued in an overlapping position over top end flap 130 and top end flap 134 and bottom end flap 142 and bottom end flap 144 respectively. Pouches 74A-H are loaded into the shipping carton 175 with one of their sides (preferably the front side 80) facing the bottom panel 118A & 118B while the shipping container is resting on side panel 114A & 114B. The carton is closed by folding side panel 122A & 122B along fold line 124 and folding top flap 126A & 126B along fold line 128 and gluing it to top flaps 112A & 112B. Side end flaps 146 and 148 are folded along fold lines 132 and 136 respectively and glued to side end flaps 138 and 140 respectively. It should be realized that the shipping carton 175 can be loaded while resting on side panel 122A & 122B as shown in FIG. 5. The position shown in FIG. 5 is the preferred position to place the shipping carton 175 to remove the opening flap 163.

As in the case of the embodiment illustrated by FIGS. 1-3 described supra, the pouches 74A-D are loaded so that their tops 76 meets the tops of pouches 74E-H at the center of the shipping carton 175 and overlap each other. For illustration purposes shipping carton 75 illustrated in FIGS. 1-3 is the same size as the shipping carton 175 illustrated in FIGS. 4-6. As in the case of shipping carton 75 the length L between fold line 132 and 136 of carton 175 is much less than double the length L' of a pouch 74A-H. Because from one fourth to one half of the top end of the pouch may overlap with the corresponding distance of an adjoining pouch, the length L of a carton may be from approximately the length L' of a pouch to one and half times the length L' of a pouch.

It will be noticed from FIG. 4 that the blank 110 is provided with a twin box fold line 150 separating side panel 122 & 122B which extends from fold line 128 to fold line 124. Parallel tear lines 152 and 154 are provided between side panel 114A & 114B and extend between fold lines 116 and 120. These tear lines 152 and 154 extend into top panel 112A and 112B as tear lines 160 and 162 which converge towards each other in top flap 112A & 112B until they meet tear line 164 which extends through both top flaps 112 & 112B and 126A & 126B which are to be glued together. Similarly tear lines 152 and 154 extend into bottom panel 118A & 118B as tear lines 156 and 158 which converge towards each other until they are interconnected to twin box fold line 150 by tear line 166.

It will be noticed that finger apertures 168 are provided for carrying the shipping carton 175.

Figure 6:
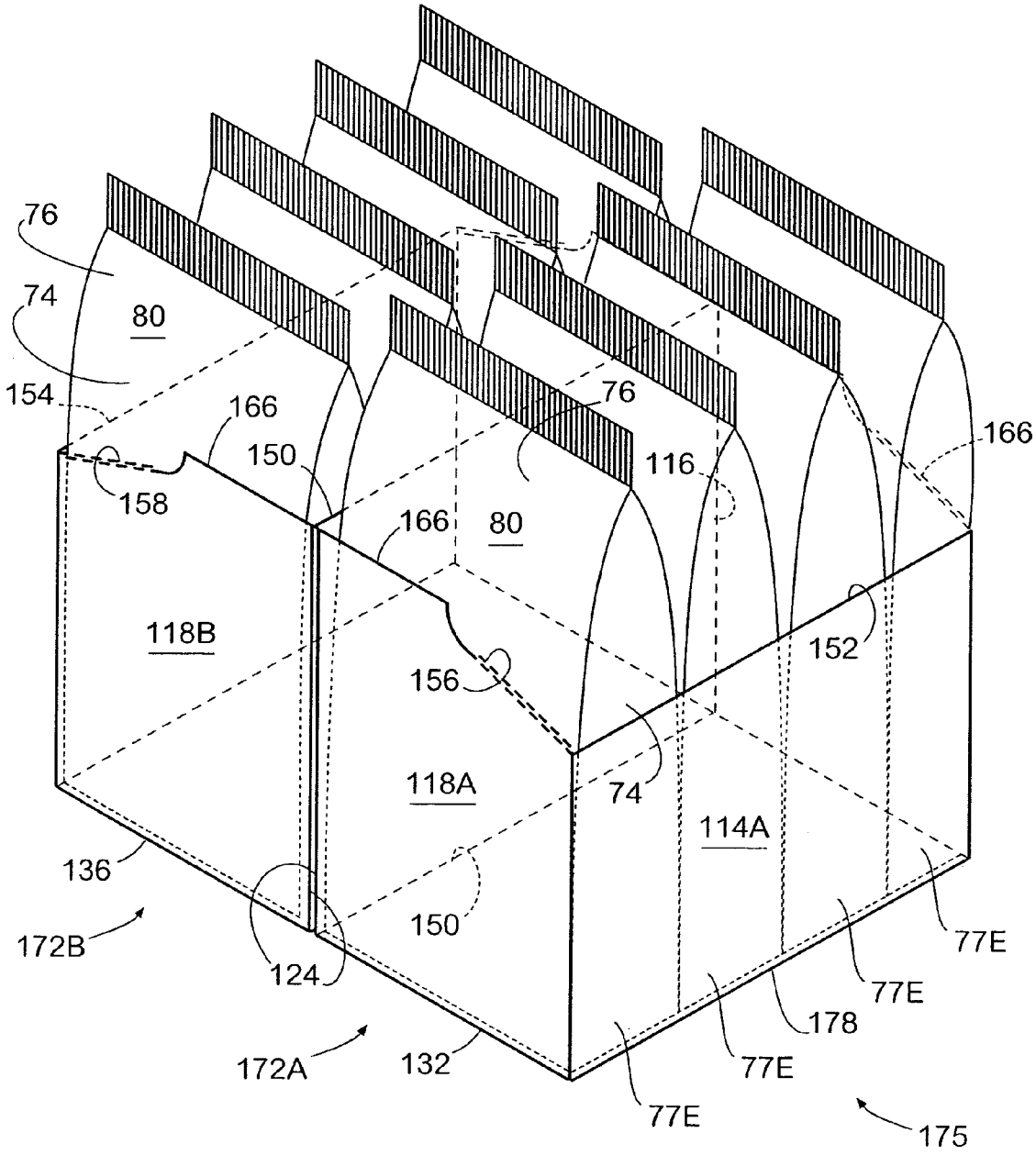
FIG. 6 is a perspective view of the twin boxes made from the shipping carton of FIG. 5 in which pouches are placed for display and dispensing.

This shipping carton 175 can be opened by resting it on side panel 122A & 122B and tearing opening flap 163 as illustrated in FIG. 5. Tear lines 152 and 154 are basically parallel to each other in side panel 114A & 114B and are also parallel to fold lines 132 and 136 between fold line 116 to 120. It should be realized that opening flap 163 can be constructed with somewhat different dimension and configuration than illustrated in FIG. 4 as long as the principles of FIG. 4 are followed. Top flap 112A & 112B, side panel 114A & 114B, bottom panel 118A & 118B and top flap 126A & 126B are torn into twin shelf dispensers 172A & 172B. This is accomplished by folding along twin box fold line 150 as illustrated in FIG. 6 in which the pouches 74 are displayed with their front side 80 with the top 76 of each pouch 74 located in the proper position for displaying purposes and dispensing. The bottom 178 is formed by top end flap 130, side end flap 138, bottom end flap 142 and side end flap 146. The bottom (not shown) of shelf dispenser 172B is formed from the corresponding end flaps of blank 110. It will be noticed that tear line 166 in both shelf dispenser 172A and 172B is located some distance from fold lines 132 and 136 which results in retaining the pouches 74 more securely in the shelf dispensers 172 & 172B. These shelf dispensers 172A & 172B are also designed to be displayed side-by-side on the shelf of the store. They can be separated from each other by cutting twin box fold line 150 which is the only place of attachment of shelf dispenser 172A to shelf dispenser 172B. Twin box fold line 150 could be constructed as a tear line for easy separation of the shelf dispensers 172A & 172B.

It will be noticed from the drawings that the twin shelf dispensers formed from each embodiment are identical to each other. It should be realized that the self dispensers formed from each embodiment could be of a different size and configuration from each other if desired by the placement of the fold line and tear lines to achieve the desired objective.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. A combination shipping and dispensing carton, comprising:

a bottom panel;

a top panel comprising a first top flap and a second top flap;

a first side panel adjacent to the bottom panel and to the top panel;

a second side panel adjacent to the bottom panel and to the top panel, the second side panel having a box fold line;

at least one first end flap closing a first end of the carton;

at least one second end flap closing a second end of the carton;

a first plurality of tear lines extending through the bottom panel, the first side panel, and the top panel; and a second plurality of tear lines extending through the bottom panel, the first side panel, and the top panel, wherein the first and second pluralities of tear lines at least partially define an opening flap in the bottom panel, the first side panel, and the top panel, the opening flap is wider in the bottom panel than in the first side panel, when the opening flap is opened, the carton can be formed into first and second side-by-side dispensers by folding the second side panel along the box fold line, the first plurality of tear lines comprises a first side panel tear line that extends toward the top panel, the second plurality of tear lines comprises a second side panel tear line that extends toward the top panel, the first and second side panel tear lines converge toward one another as they extend toward the top panel, and the first plurality of tear lines and the second plurality of tear lines extend through the first top flap and the second top flap.

2. The carton of claim 1, wherein:

the first plurality of tear lines comprises a first bottom panel tear line;

the second plurality of tear lines comprises a second bottom panel tear line; and the first and second bottom panel tear lines diverge from one another at a location adjacent to the first side panel.

3. The carton of claim 2, wherein:

the first plurality of tear lines comprises a first top panel tear line;

the second plurality of tear lines comprises a second top panel tear line; and the first and second top panel tear lines extend substantially parallel to one another in the top panel.

4. The carton of claim 3, wherein the first and second bottom panel tear lines converge toward each other at a location adjacent to the second side panel.

5. The carton of claim 3, wherein the first top panel tear line is approximately the same distance from the first end of the carton as the second top panel tear line is from the second end of the carton.

6. The carton of claim 1, wherein the dispensers are of approximately the same size and configuration.

7. The carton of claim 1, further comprising:

an opening flap fold line connecting the first plurality of tear lines to the second plurality of tear lines, wherein the box fold line extends from a point adjacent to the opening flap fold line.

8. The carton of claim 1, wherein the at least one first end flap closing a first end of the carton comprises:

a first side end flap; and a second side end flap.

9. The carton of claim 1 and a plurality of pouches therein, wherein the first and second dispensers are capable of displaying the pouches in an upright position.

10. The carton of claim 1, further comprising:

an opening flap fold line connecting the first plurality of tear lines to the second plurality of tear lines, wherein the box fold line extends from a point adjacent to the opening flap fold line.

11. The carton of claim 1, comprising:

means for closing the end flaps.

12. The carton of claim 1 and a plurality of pouches therein, wherein the first and second dispensers are capable of displaying the pouches in an upright position, and wherein the plurality of pouches are arranged in a first row on a first side of the carton, and a second row on a second side of the carton, the rows of pouches overlapping at tops of the pouches.

13. A method of displaying items, comprising:

providing a carton according to claim 1 and a plurality of pouches arranged in a first row on a first side of the carton, and a second row on a second side of the carton, the rows of pouches overlapping at tops of the pouches;

removing the opening flap; and folding along the box fold line until a first portion of the second side panel abuts a second portion of the second side panel, wherein tops of the pouches extend from tops of the dispensers.

14. A combination shipping and dispensing carton, comprising:

a bottom panel;

a top panel;

a first side panel adjacent to the bottom panel and to the top panel;

a second side panel adjacent to the bottom panel and to the top panel, the second side panel having a box fold line;

at least one first end flap closing a first end of the carton;

at least one second end flap closing a second end of the carton;

a first plurality of tear lines extending through the bottom panel, the first side panel, and the top panel; and a second plurality of tear lines extending through the bottom panel, the first side panel, and the top panel; and a cut line in the second side panel connecting the first and second pluralities of tear lines, the cut line and an opening flap fold line defining a starting flap in the second side panel, wherein the first and second pluralities of tear lines at least partially define an opening flap in the bottom panel, the first side panel, and the top panel, the opening flap is wider in the bottom panel than in the first side panel, when the opening flap is opened, the carton can be formed into first and second side-by-side dispensers by folding the second side panel along the box fold line, the first plurality of tear lines comprises a first side panel tear line that extends toward the top panel, the second plurality of tear lines comprises a second side panel tear line that extends toward the top panel, and the first and second side panel tear lines converge toward one another as they extend toward the top panel.

15. The carton of claim 14, wherein:

the top panel comprises a first top flap and a second top flap; and the first plurality of tear lines and the second plurality of tear lines extend through the first top flap and the second top flap.

16. The carton of claim 14, wherein the at least one first end flap closing a first end of the carton comprises:

a first side end flap; and a second side end flap.

17. A combination shipping and dispensing carton and a plurality of pouches, the carton comprising:

a bottom panel;

a top panel;

a first side panel adjacent to the bottom panel and to the top panel;

a second side panel adjacent to the bottom panel and to the top panel, the second side panel having a box fold line;

at least one first end flap closing a first end of the carton;

at least one second end flap closing a second end of the carton;

a first plurality of tear lines extending through the bottom panel, the first side panel, and the top panel, the first plurality of tear lines comprising:

a first side panel tear line;

a first top panel tear line; and a first bottom panel tear line;

a second plurality of tear lines extending through the bottom panel, the first side panel, and the top panel, the second plurality of tear lines comprising:

a second side panel tear line;

a second top panel tear line; and a second bottom panel tear line, wherein the first and second side panel tear lines extend toward the at least one top panel and converge toward one another as they extend toward the top panel;

an opening flap fold line connecting the first plurality of tear lines to the second plurality of tear lines; and a cut line in the second side panel connecting the first and second pluralities of tear lines, the cut line and the opening flap fold line defining a starting flap in the second side panel, wherein the first and second pluralities of tear lines and the opening flap fold line at least partially define an opening flap in the bottom panel, the first side panel, and the top panel, the opening flap is wider in the bottom panel than in the first side panel, the box fold line extends from a point adjacent to the opening flap fold line, when the opening flap is opened, the carton can be formed into first and second side-by-side dispensers of approximately the same size and configuration by folding along the box fold line, and the plurality of pouches are arranged in a first row on a first side of the carton, and a second row on a second side of the carton, the rows of pouches overlapping at tops of the pouches.

18. The carton of claim 17, wherein:

the first and second top panel tear lines extend substantially parallel to one another in the top panel; and the first and second bottom panel tear lines diverge from one another at a location adjacent to the first side panel.

19. The carton of claim 18, wherein the first and second bottom panel tear lines converge toward each other at a location adjacent to the second side panel.

20. A blank for forming a combination shipping and dispensing carton, comprising:

a bottom panel;

a first side panel foldably connected to the bottom panel;

a first top flap foldably connected to the first side panel;

a second side panel having a box fold line;

a first plurality of end flaps extending along a first marginal area of the blank;

a second plurality of end flaps extending along a second marginal area of the blank;

a first plurality of tear lines extending through the bottom panel, the first side panel, and the first top flap;

a second plurality of tear lines extending through the bottom panel, the first side panel, and the first top flap; and a second top flap foldably connected to the second side panel, wherein the first plurality of tear lines and the second plurality of tear lines extend through the second top flap, wherein the first and second pluralities of tear lines at least partially define an opening flap in the bottom panel, the first side panel, and the first top flap, the opening flap is wider in the bottom panel than in the first side panel, the first plurality of tear lines comprises a first side panel tear line that extends toward the top panel, the second plurality of tear lines comprises a second side panel tear line that extends toward the top panel, and the first and second side panel tear lines converge toward one another as they extend toward the top panel.

21. The blank of claim 20, wherein:

the first plurality of tear lines comprises a first bottom panel tear line;

the second plurality of tear lines comprises a second bottom panel tear line; and the first and second bottom panel tear lines diverge from one another at a location adjacent to the first side panel.

22. The blank of claim 21, wherein:

the first plurality of tear lines comprises a first top flap tear line;

the second plurality of tear lines comprises a second top flap tear line; and the first and second first top flap tear lines extend substantially parallel to one another in the first top flap.

23. The blank of claim 21, wherein the first and second bottom panel tear lones converge toward each other at a location adjacent to the second side panel.

24. The blank of claim 21, wherein the first top flap tear line is approximately the same distance from the first marginal area as the second first top flap tear line is from a second marginal area.

25. The blank of claim 21, further comprising:

an opening flap fold line in the second side panel connecting the first plurality of tear lines to the second plurality of tear lines, wherein the box fold line extends from a point adjacent to the opening flap fold line.

26. The blank of claim 20, further comprising:

an opening flap fold line in the second side panel connecting the first plurality of tear lines to the second plurality of tear lines, wherein the box fold line extends from a point adjacent to the opening flap fold line.

27. A blank for forming a combination shipping and dispensing carton, comprising:

a bottom panel;

a first side panel foldably connected to the bottom panel;

a second side panel having a box fold line;

a first plurality of end flaps extending along a first marginal area of the blank;

a second plurality of end flaps extending along a second marginal area of the blank;

a first plurality of tear lines extending through the bottom panel, the first side panel, and the first top flap, the first plurality of tear lines comprising a first bottom panel tear line;

a second plurality of tear lines extending through the bottom panel, the first side panel, and the first top flap, the second plurality of tear lines comprising a second bottom panel tear line; and a cut line in the second side panel connecting the first and second pluralities of tear lines, the cut line and an opening flap fold line defining a starting flap in the second side panel, wherein the first and second pluralities of tear lines at least partially define an opening flap in the bottom panel, the first side panel, and the first top flap, the opening flap is wider in the bottom panel than in the first side panel, the first plurality of tear lines comprises a first side panel tear line that extends toward the top panel, the second plurality of tear lines comprises a second side panel tear line that extends toward the top panel, the first and second side panel tear lines converge toward one another as they extend toward the top panel, and the first and second bottom panel tear lines diverge from one another at a location adjacent to the first side panel.

28. The blank of claim 27, further comprising:

a second top flap foldably connected to the second side panel, wherein the first plurality of tear lines and the second plurality of tear lines extend through the second top flap.

* * * * *